US005815891A

United States Patent [19]

Students et al.

[11] Patent Number: 5,815,891

[45] Date of Patent: Oct. 6, 1998

[54] CABLE TIE WITH BENT BARB

[75] Inventors: John J. Students, Collierville; Peter M. Wells, Jr., Germantown, both of Tenn.

[73] Assignee: Thomas & Betts Corporation, Memphis, Tenn.

[21] Appl. No.: 795,847

[22] Filed: Feb. 6, 1997

[51] Int. Cl.[6] ..... B65D 63/00

[52] U.S. Cl. ..... 24/16 PB; 24/17 AP; 24/30.5 P

[58] Field of Search ..... 24/16 PB, 17 AP, 24/30.5 P

[56] References Cited

U.S. PATENT DOCUMENTS

| | | | |
|---|---|---|---|
| 3,186,047 | 6/1965 | Schwester et al. | 24/16 PB |
| 3,408,699 | 11/1968 | Reynolds | 24/16 PB |
| 3,488,813 | 1/1970 | Kohke | 24/16 PB |
| 3,965,538 | 6/1976 | Caveney et al. | 24/16 PB |
| 4,272,870 | 6/1981 | McCormick . | |
| 4,498,507 | 2/1985 | Thompson . | |
| 5,121,524 | 6/1992 | Mortensen . | |
| 5,193,251 | 3/1993 | Fortsch | 24/16 PB |
| 5,513,421 | 5/1996 | Wells | 24/16 PB |
| 5,517,727 | 5/1996 | Bernard et al. | 24/17 AP |
| 5,630,252 | 5/1997 | Wells | 24/30.5 P |

*Primary Examiner*—Victor N. Sakran
*Attorney, Agent, or Firm*—Hoffmann & Baron, LLP

[57] ABSTRACT

A cable tie includes an elongate generally planar strap and a head. The head of the cable tie includes an aperture therethrough for insertably accommodating the strap. The head of the cable tie also includes a barb embedding surface adjacent the aperture through the head. A metallic locking barb is embedded in the embedding surface in a direction substantially parallel to the aperture in the head. The metallic locking barb is bent to form an obtuse angle so that the metallic locking barb extends into the aperture in the head to permit movement of the strap in an insertion direction and to prevent substantial movement of the strap in a withdrawal direction.

2 Claims, 9 Drawing Sheets

CABLE TIE WITH BENT BARB

FIELD OF THE INVENTION

The present invention relates to cable ties used to bundle an article or a group of articles. More specifically, the present invention relates to cable ties having a metallic locking barb and an improved method of making the same.

BACKGROUND OF THE INVENTION

The use of cable ties to bundle or secure a group of articles is well known. Known cable ties of conventional construction are elongate members having a head at one end, a tail at the other end, and a longitudinal strap therebetween. The strap is wrapped around a bundle of articles and the tail is inserted through an aperture or passage in the head. The head of the cable tie typically includes a locking element which is engagable with the body of the strap so that when the tail is pulled through the aperture in the head, the locking element secures the strap body in the head.

From an ergonomic and performance perspective, a cable tie should ideally require low insertion forces to engage the strap in the head while also providing high long-term loop tensile strength for better securement of the bundle. Two distinct approaches have emerged for attaining these dual goals of cable tie design. The first approach, as demonstrated by U.S. Pat. No. 3,965,538, forms a one-piece cable tie where the locking element is formed integrally within the head of the cable tie. Such cable ties require relatively low insertion forces but provide relatively lower long-term loop tensile strength. The second approach to cable tie design employs a metal barb embedded in the head at an acute angle to the inserted tail. The metal barb bites into the strap upon any attempt to withdraw the strap therefrom. These cable ties generally require a relatively higher insertion force but provide a relatively higher long-term loop tensile strength.

Fabricating cable ties with an embedded metallic barb is complicated by the design of the cable tie head and the clearances afforded by the channel therethrough. Embedding the barb within the head so that one free end of the barb protrudes into the head passage must be accomplished within the minimal space provided by the passage. Previous attempts in the art to provide more room for embedding a barb in the head of a cable tie include providing a notch in the head wall directly across the passage from the intended location of the barb. U.S. Pat. No. 5,517,727, for example, provides a channel in the head for greater clearance when inserting the barb. But such a channel in the head wall reduces the effective thickness of the head and, therefore, the overall strength of the head. Furthermore, higher insertion forces are required to force the barb into the head wall because the barb embedding angle precludes formation of a starter-hole during fabrication of the cable tie body.

U.S. Pat. No. 5,193,251 discloses a cable tie having a pair of bent locking barbs, where one leg of each barb is supported in the cable tie head on a flexible platform. The barbs in the head of the '251 patent are pre-formed into the bent shape prior to insertion into the cable tie head.

In view of a need to provide a cable tie having low strap insertion force as well as high tensile withdrawal force, it is desirable to provide a cable tie with a semi-embedded locking barb and an improved method of forming a cable tie with a semi-embedded locking barb.

SUMMARY OF THE INVENTION

It is an object of the present invention to provide a cable tie having a head which receives a strap of the tie and locks the strap in the head and which provides low strap insertion force and high long-term loop tensile strength.

It is another object of the present invention to facilitate the manufacture of a cable tie having a locking barb which may be easily insertably supported by the head.

In the efficient attainment of these and other objects, the present invention provides a bundling tie including an elongate strap body and a head having an aperture therealong for insertably accommodating the strap body. A metallic barb is supported in the head for locking engagement with the strap body. The barb is initially formed as an elongate planar member and is embedded into the head. Once embedded, the barb is bent to form an obtuse angle so that a portion of the barb extends into the aperture for locking engagement with the strap body upon insertion thereinto.

DETAILED DESCRIPTION OF THE PREFERRED EMBODIMENT

Figure 1:
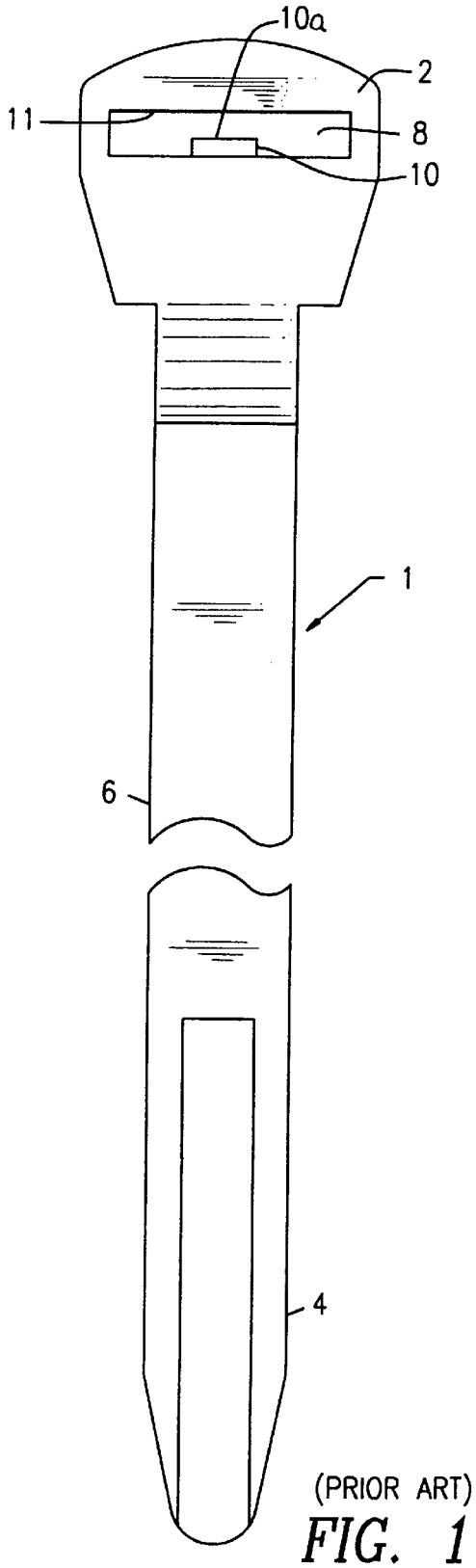
(PRIOR ART) FIG. 1
FIG. 1 shows a bottom plan view of a cable tie of the prior art includes a head, a strap body and a locking barb in the head.
Figure 2:
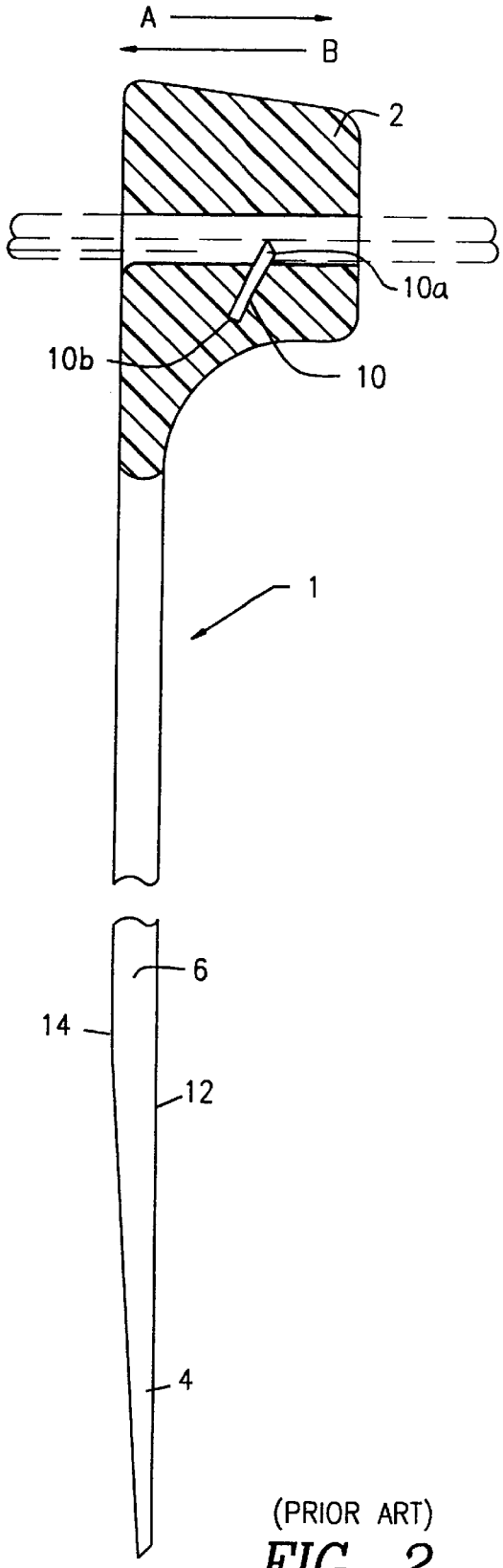
(PRIOR ART) FIG. 2
FIG. 2 is a side elevational view, partly in section, of the cable tie of FIG. 1.

FIGS. 1 and 2 show a cable tie 1 of the prior art. Cable tie 1 is an elongate integrally formed member including a head 2, an opposed tail 4, and an elongate strap body 6 therebetween. Strap body 6 is typically planar shaped having first and second opposed surfaces 12 and 14. Head 2 includes a passageway 8 passing therethrough for receipt of tail 4 and strap body 6. Passageway 8 is defined by head wall 11. Head 2 also includes metallic locking barb 10 embedded within the head 2 which, as will be more fully discussed below, is positioned to engage strap body 6 when inserted through passageway 8 in the direction of arrow A. While the head, strap and tail are shown in the preferred embodiment as an integrally formed unit, it is within the contemplation of the present invention to form the head separately from the strap and tail.

Barb 10 is preferably formed of stainless steel or a copper alloy and includes a knife-like end 10*a* extending into passageway 8. Barb 10 includes an opposing end 10*b* which extends into head 2 so as to allow barb 10 to deflect in a cantilevered manner when tail 4 and strap 6 are inserted through passageway 8. The passage of strap 6 into passageway 8 is shown in FIG. 2 by phantom lines. As is common in barb type cable ties of the prior art, barb 10 is positioned in head 2 such that it provides biting engagement with strap 6 upon an attempt to withdraw the strap in the direction of arrow B.

Barb-type cable ties are typically fabricated in a two-step process in that first the head, tail, and strap body are injection molded and then the barb is inserted into position in the head. The fabrication process is complicated by the small work area provided by the passageway for proper insertion of the barb. The present invention facilitates the manufacturing process by providing a planar rectangular barb which is inserted into the head in a direction generally parallel to the passageway and which is then bent to properly position the barb with respect to the inserted tail.

Figure 3:
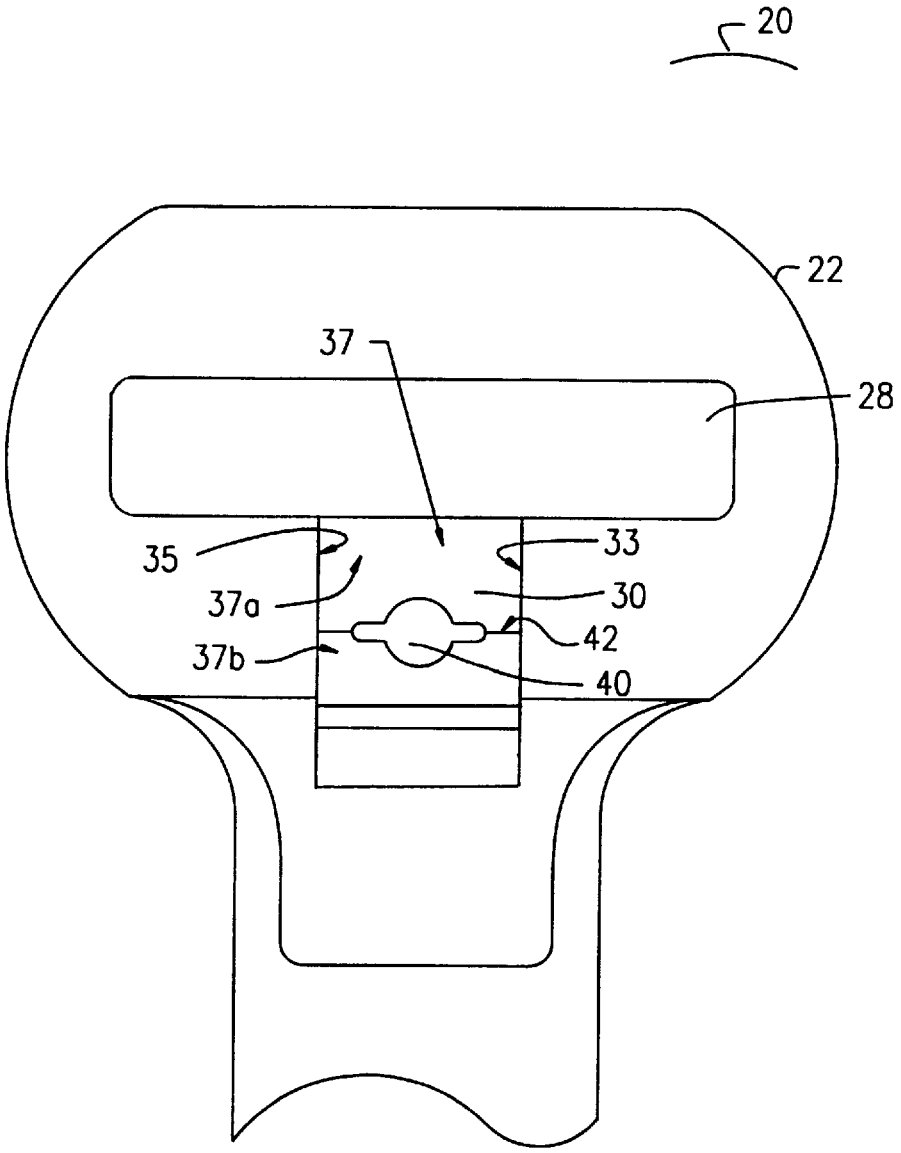
FIG. 3 is a front view of the head of the cable tie of the present invention, prior to installation of the locking barb of the present invention.
Figure 4:
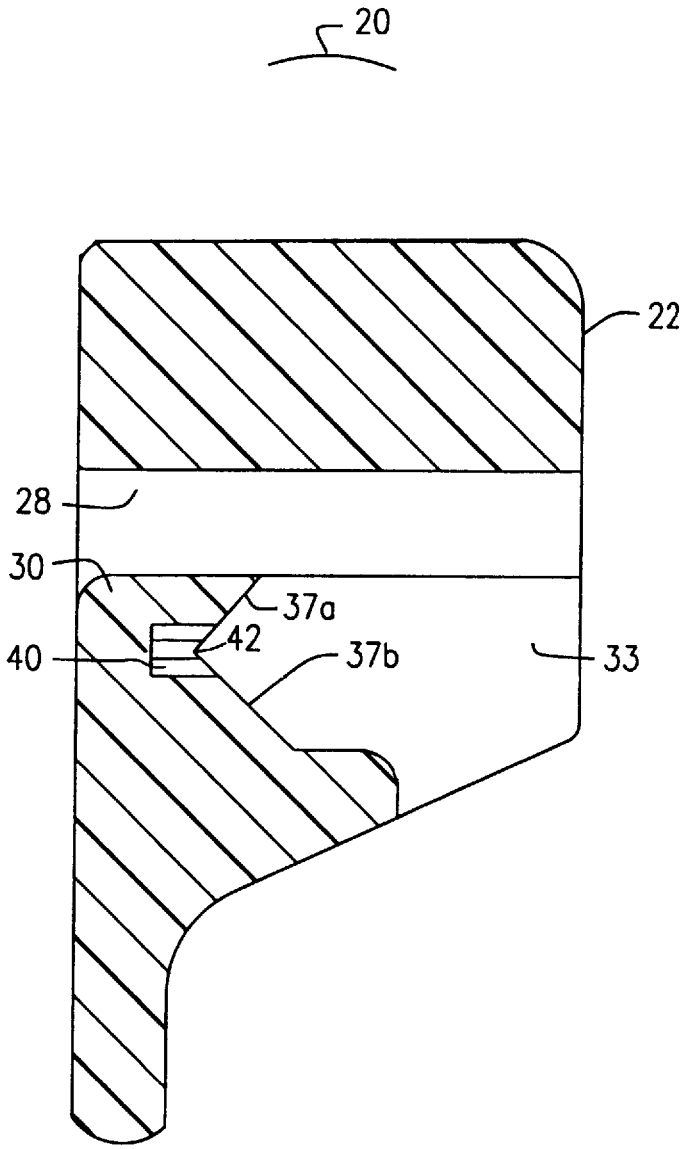
FIG. 4 is a side view, in section, of the head of the cable tie of FIG. 3.
Figure 5:
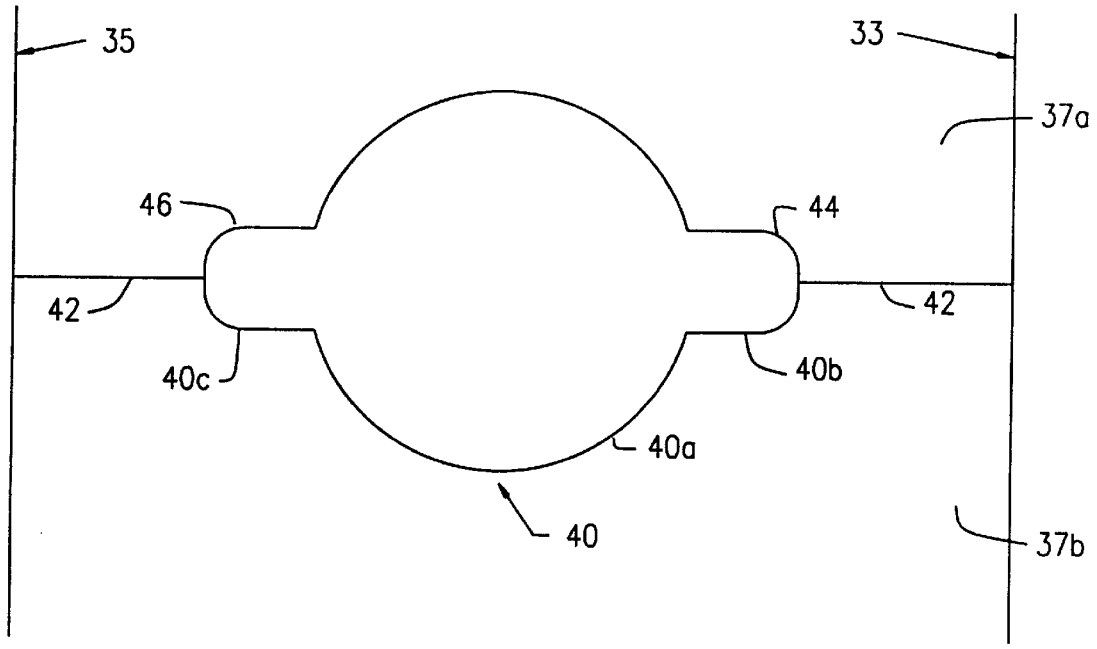
FIG. 5 shows in detail the barb aperture of the cable tie of the present invention.
Figure 6:
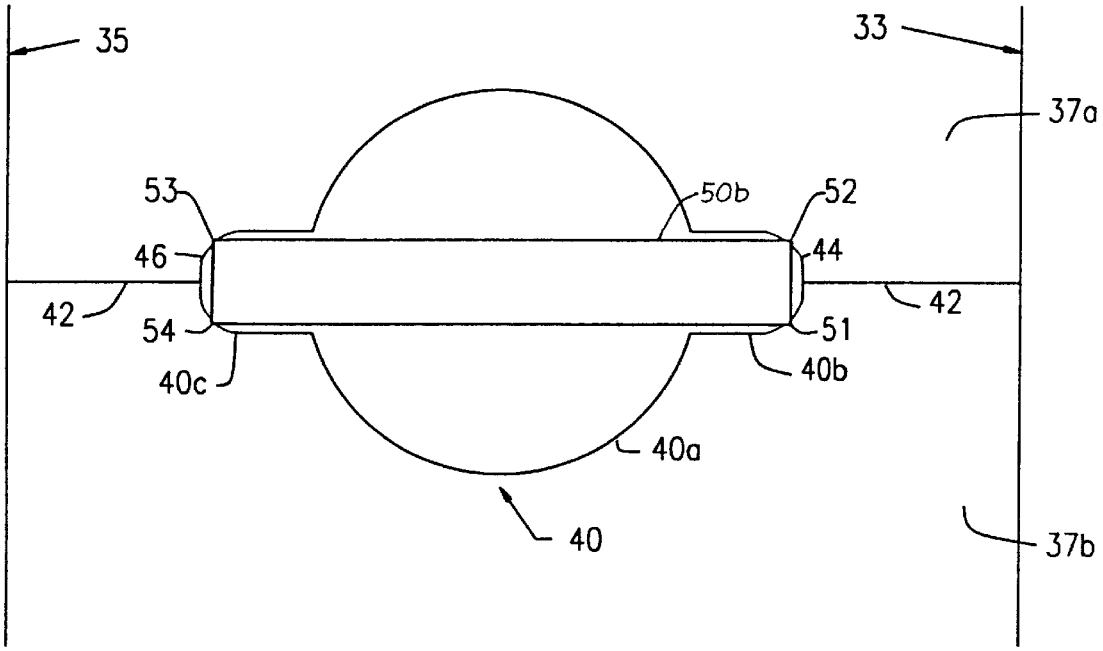
FIG. 6 shows in detail a barb aperture of the cable tie of the present invention and the fit of the embedded locking barb therein.

FIGS. 3–10 detail the head portion of a cable tie of the present invention. Cable tie 20 may include a strap 6 and tail 4 as known in the prior art and which herein retain the numbering of FIGS. 1 and 2. Cable tie 20 is formed of an elastomeric material such as nylon, polypropylene, or any other material familiar to the cable tie art. FIGS. 3 and 4 shows that the present invention provides a modified head 22 with a passageway 28 therethrough for accepting inserted tail 4 and strap 6. Head 22 further includes barb accommodating portion 30 adjacent passageway 28 and defined between opposing sidewalls 33 and 35. A barb embedding surface 37 is formed in barb accommodating portion 30 and is preferably non-planar and includes both an angled barb stop surface 37*a* located adjacent passageway 28 and an opposed angled surface 37*b*.

As shown in FIGS. 3–6, a barb aperture 40 is formed in barb embedding surface 37 and is defined by the junction of pawl stop surface 37*a* and surface 37*b*. Barb aperture 40 is preferably shaped as shown in that it is generally defined by a cylindrical portion 40*a* with diametrical wing portions 40*b* and 40*c* laterally radiating along junction line 42 and in communication with cylindrical portion 40*a*. Wing portions 40*b* and 40*c* terminate at curved endwalls 44 and 46, respectively.

The particular shape of barb aperture 40 is selected so as to include a partially oversized aperture for the benefit of the die which forms cable tie 20. Barb aperture 40 is formed by a projection in the mold (not shown) around which the cable tie material is injected. When the mold projection includes a cylindrical element which forms portion 40*a*, it has been found that the mold projection is stronger and more resistant to breakage than if the mold projection was a simply similar to the cross-sectional shape of the embedded barb. The cable tie mold can therefore be expected to have a longer useful life when the projection has a thicker cross section.

The present invention contemplates that portion 40*a* of barb aperture 40 may also have other shapes, such as a square, a rectangle or an oval, for example. Portion 40*a* is also contemplated as being disposed either fully or partially to one side of junction line 42. The benefit of portion 40*a* is directed to the integrity of the mold used to form the cable tie of the present invention and therefore any means of reinforcing the mold protrusion which forms surfaces 44 and 46 in aperture 40 is within the contemplation of the present invention.

Furthermore, wing portions 40*b* and 40*c* may similarly be located either fully or partially to one side of junction 42. Providing a partially oversized aperture 40 results in less plastic material securing the barb. Therefore, the barb is more able to rotate in the embedding area and the force required to insert tail 4 and strap 6 through passage 8 in direction A is reduced. Barb rotation aids strap insertion by reducing the amount the barb must deflect to allow tail 4 and strap 6 to pass. Embedding the barb in a direction parallel to passageway 8 also assures that headwall thickness and strength is not sacrificed to allow barb assembly into head 22.

FIGS. 6–10 illustrate a method of performing the second step of manufacturing the cable tie of the present invention. Preferably, locking barb 50 is initially formed as an elongate rectangular planar member having opposing ends 50*a* and 50*b* and four longitudinal corner edges 51, 52, 53, and 54. The barb is preferably formed of stainless steel or a copper alloy and includes a knife-like strap engagement end 55 on the free extent of end 50*a*. Barb end 50*b* is retentively set into barb aperture 40 and preferably retained therein by an interference fit between longitudinal corner edges 51, 52, 53, and 54 and curved endwalls 44 and 46 of wing portions 25*b* and 25*c*, respectively.

Figure 7:
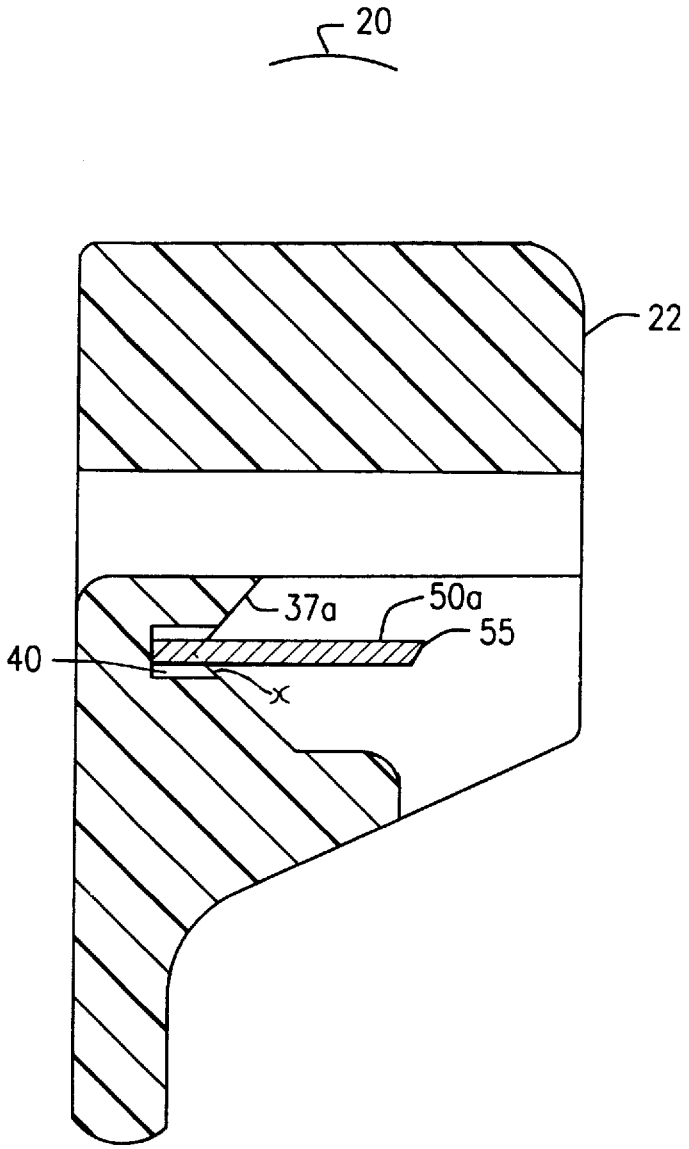
FIG. 7 is a side view, in section, of the head of the cable tie of the present invention, with an unbent locking barb inserted into the barb aperture.
Figure 8:
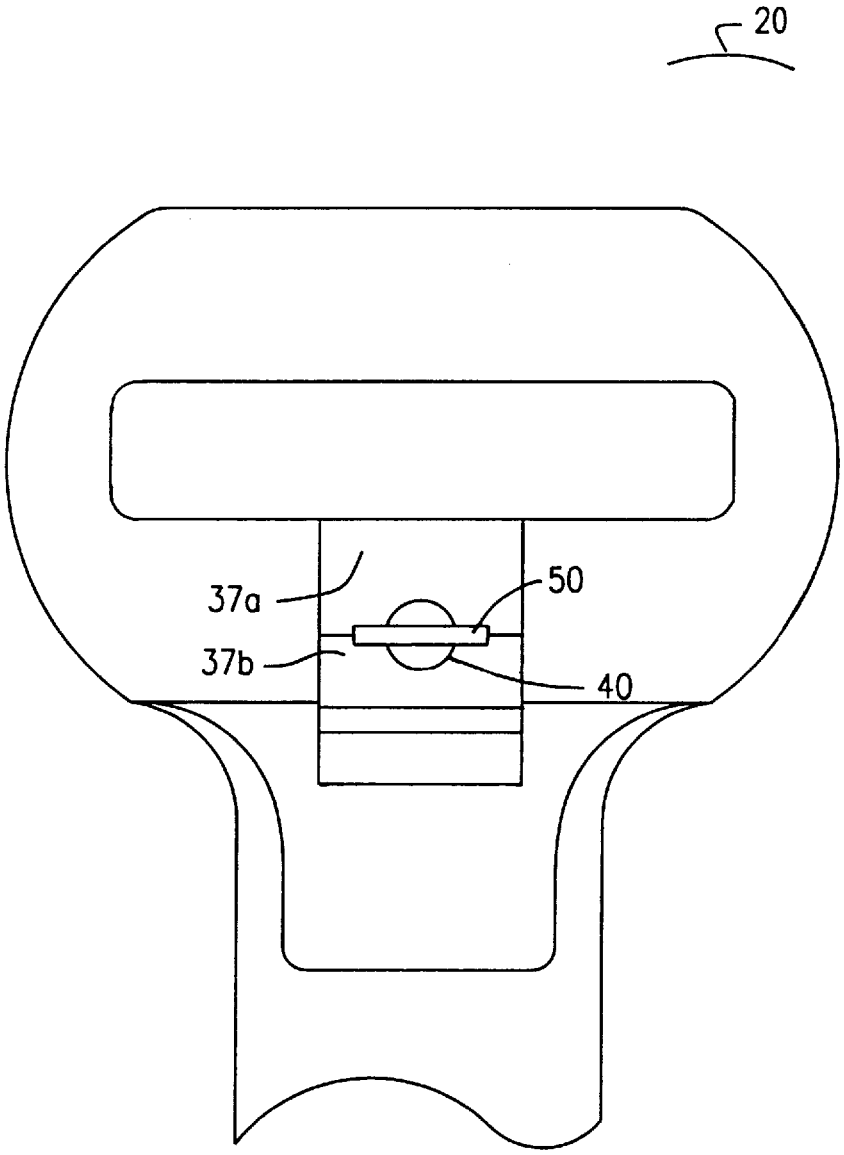
FIG. 8 is a top view of the head of the cable tie of FIG. 7.
Figure 9:
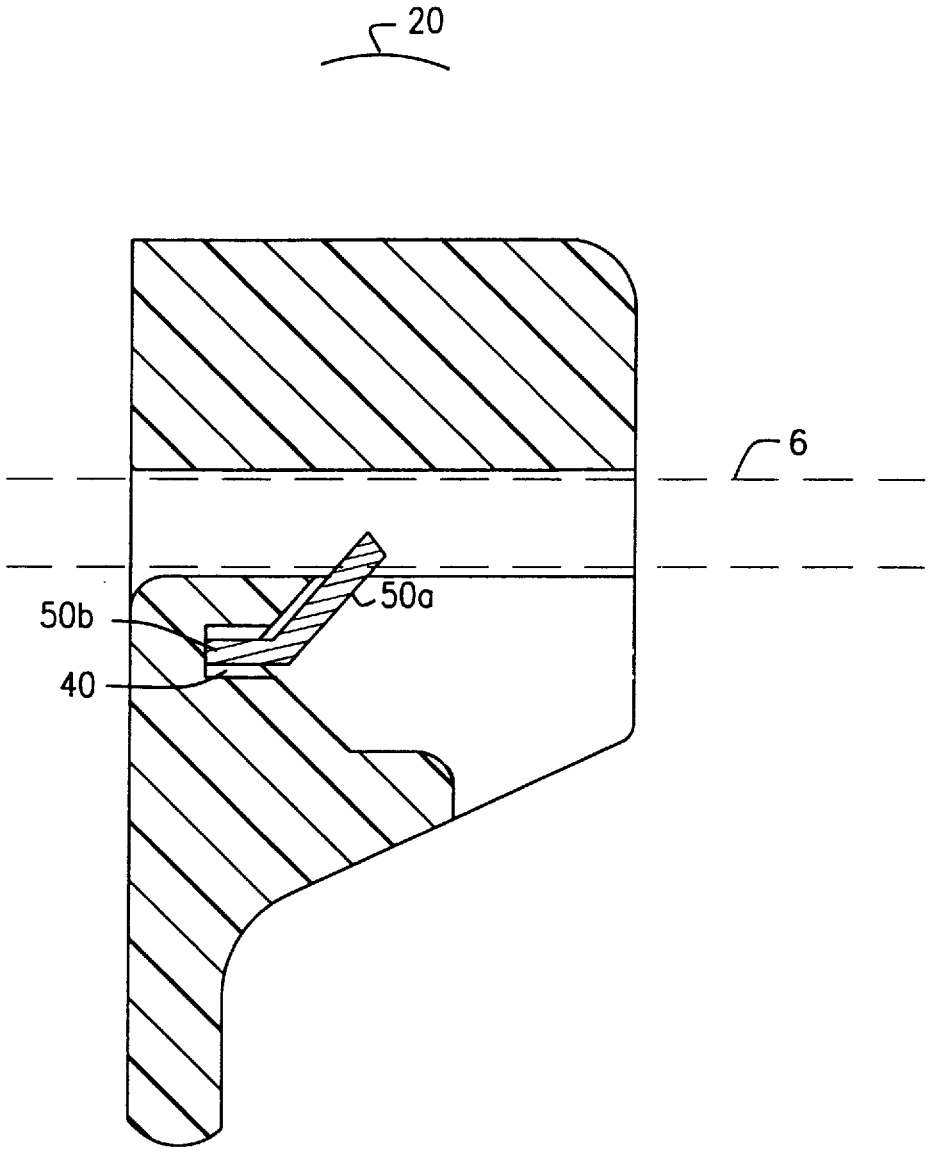
FIG. 9 is a side view, in section, of the head of the cable tie of the present invention, with a bent locking barb inserted into the barb aperture.
Figure 10:
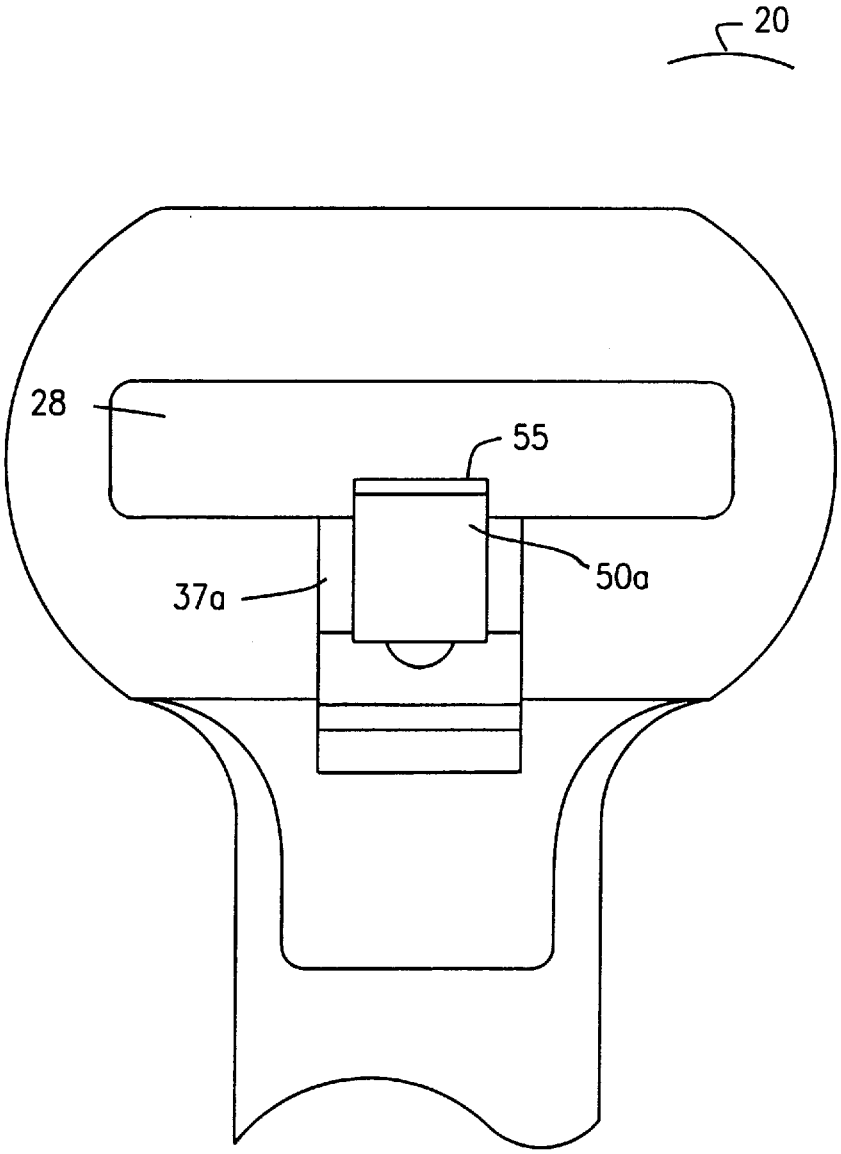
FIG. 10 is a top view, of the head of the cable tie of FIG. 9.

Once inserted into barb aperture 40 as shown in FIGS. 7 and 8, locking barb 50 may be bent so that ends 50*a* and 50*b* form an oblique angle as shown in FIGS. 9 and 10. Once bent, end 50*a* will project into passageway 28 so that end 55 may engage strap 6 when inserted through head 22. Bent barb 50 thereby facilitates the manufacture of the cable tie of the present invention since barb 50 may be inserted into head 22 in a direction substantially parallel to passageway 28, reducing the clearance required to form a cable tie having an embedded locking barb. Bending may be accomplished by any method known in the art. For example, barb 50 may be grasped by the opposed arms of an appropriate tool (not shown) at end 50*b* adjacent point x. A bending force could then be applied to end 50*a* that bends barb 50 about point x. The bending force would be applied until barb 50 is deformed so that end 55 protrudes into passageway 28 for engaging strap 6. Other tooling well known in the metal shaping art may also be employed.

In conventional operation known for cable ties, tail 4 is wrapped around a bundle of articles and inserted in direction A into end 28*a* of passageway 28 through head 22. Tail 4, shown in FIG. 9 by phantom lines, extends through passageway 28, exiting head 22 through passageway end 28*b*. As the strap is similarly pulled through passageway 28, end 50*a* of locking barb 50 is cantilever deflected and barb 50 may be partially rotated in the direction of the strap travel. Tail 4 may pulled through head 22 until the cable tie tightly encircles the bundle of articles. Barb surface 37*a*, acting as a stop, prevents over-deflection of barb 50 when forces act to pull strap 6 in direction B back through end 28*a* of passageway 28.

While the particular preferred embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A method of making a bundling tie comprising:

forming a bundling tie body, said bundling tie body including an elongate planar strap, a head having a strap aperture therethrough for insertably accommodating said strap, said head further including a barb embedment surface adjacent said strap aperture; and forming a substantially planar metallic locking barb having an insertion end and an opposed strap engagement end;

embedding said insertion end of said locking barb into said barb embedment surface; and bending said barb to form an obtuse angle so that said strap engagement end of said locking barb extends into said aperture to permit movement of said strap in an insertion direction through said aperture in said head and to provide locking engagement of the strap inserted through said aperture in said head to prevent withdrawal of said strap in a withdrawal direction opposite said insertion direction.

2. A method of claim 1 wherein said forming step includes:

forming said head to include a barb aperture in said barb embedment surface, said barb aperture insertably accommodating said barb upon said embedding step.

* * * * *